US005831471A

United States Patent [19]

Nakajima et al.

[11] Patent Number: 5,831,471

[45] Date of Patent: Nov. 3, 1998

[54] DC-STABILIZED POWER CIRCUIT

[75] Inventors: Akio Nakajima; Isao Satoh, both of Kitakatsuragi-gun, Japan

[73] Assignee: Sharp Kabushiki Kaisha, Osaka, Japan

[21] Appl. No.: 678,794

[22] Filed: Jul. 12, 1996

[30] Foreign Application Priority Data

Jul. 13, 1995 [JP] Japan ..... 7-177659
May 27, 1996 [JP] Japan ..... 8-132224

[51] Int. Cl.[6] ..... G05F 1/10

[52] U.S. Cl. ..... 327/540; 327/538; 323/316

[58] Field of Search ..... 327/538, 540, 327/542; 323/316

[56] References Cited

U.S. PATENT DOCUMENTS

| | | | |
|---|---|---|---|
| 4,885,477 | 12/1989 | Bird et al. | 323/316 |
| 4,928,056 | 5/1990 | Pease | 323/316 |
| 5,376,840 | 12/1994 | Nakayama | 327/537 |
| 5,467,052 | 11/1995 | Tsukada | 327/543 |
| 5,493,234 | 2/1996 | Oh | 326/33 |

OTHER PUBLICATIONS

Hitachi HA17800P Series (Semiconductor Data Book: Industrial Linear IC, Interface–Use IC) (Published in Mar. 1982, pp. 100–103.).

*Primary Examiner*—Terry Cunningham
*Attorney, Agent, or Firm*—David G. Conlin; William J. Daley, Jr.

[57] ABSTRACT

A dc-stabilized power circuit which has a PNP-type output transistor that is connected between input and output terminals, a base-driving circuit for controlling the driving current of the base of the output transistor in response to the difference between a voltage obtained by voltage-dividing the output voltage from the output terminal and a reference voltage that has been preliminarily determined, and a driving-current suppressing circuit for detecting a voltage between the input and output terminals and for suppressing a driving current released by the driving-current supplying means based upon the result of the detection. The greater the input-output voltage, the further the driving-current suppressing circuit suppresses the driving current from the base-driving circuit to the output transistor, thereby suppressing the output current. Thus, in a dc-stabilized power circuit of a low-loss type which has no current-detecting resistor connected in the output line and which is provided with a control circuit that is constructed as an integrated circuit and that supplies a driving current to the base of the output transistor in response to the output voltage, the power loss due to the output transistor is suppressed to not more than a predetermined level; therefore, it is possible to prevent damage to the output transistor beforehand.

9 Claims, 7 Drawing Sheets

DC-STABILIZED POWER CIRCUIT

FIELD OF THE INVENTION

The present invention relates to a dc-stabilized power circuit, and more specifically concerns a dc-stabilized power circuit of low-loss type that uses a PNP-type transistor as an output transistor and that has no current-detection-use resistors provided in its output line. The dc-stabilized power circuit of the present invention has such functions that it is capable of reducing the power loss in the above-mentioned output transistor and thereby protecting the output transistor.

BACKGROUND OF THE INVENTION

FIG. 7 is a block diagram showing an electrical construction of a typical prior-art dc-stabilized power circuit 1. This dc-stabilized power circuit 1, which is a general-use, so-called three-terminal regulator, has an output transistor Tr1 of the NPN-type that is connected between input and output lines 2 and 3 that extend from an input terminal T1 to an output terminal T2, and a current-detecting resistor S1 is provided in the output line 3.

Tap resistors S2 and S3 are connected between the output terminal T2 and a ground terminal T3, and the connecting point 4 is connected to the inversion input terminal of a differential amplifier 5. A reference voltage Vref is applied to the non-inversion input terminal of the differential amplifier 5. Therefore, the lower the electric potential of the connecting point 4 compared with the reference voltage Vref, the greater current the differential amplifier 5 applies to the base of the driving transistor Tr2. The collector of the driving transistor Tr2 is connected to the input terminal T1, and the emitter is connected to the base of the output transistor Tr1. Therefore, the lower the electric potential of the connecting point 4 compared with the reference voltage Vref, the greater current is outputted through the output transistor Tr1; thus, a constant voltage operation is carried out.

Further, resistors S4 and S5 are connected between the base and emitter of the output transistor Tr1, and the electric potential of their connecting point 6 is inputted to an over-current protection circuit 7 and an input-output voltage detecting circuit 8. The over-current protection circuit 7 detects a current flowing through the output line 3 due to a voltage across the connecting point 6 and the output terminal T2, and when it detects an over-current, suppresses a driving current directed to the driving transistor Tr2 from the differential amplifier 5 so as to cancel the over-current.

Moreover, the input-output voltage detecting circuit 8 detects a voltage across the connecting point 6 and the input terminal T1, and when the voltage becomes greater, that is, when the power loss of the output transistor Tr1 consequently becomes greater, suppresses a driving current directed to the driving transistor Tr2.

Therefore, in this dc-stabilized power circuit 1, the relationship between the output current Io and the output voltage Vo has so-called "knife-edge shaped" characteristics, as shown in FIG. 8. In FIG. 8, reference symbols $\alpha 1$, $\alpha 2$ and $\alpha 3$ respectively correspond to input-output voltages Vi-o that are the differences between the input voltage Vi and the output voltage Vo. Consequently, as the input-output voltage Vi-o becomes greater, the output current Io becomes smaller, as shown by the reference symbols al through $\alpha 3$, so that the protecting operation for the output transistor Tr1 is carried out by suppressing the output current Io in response to an increase in the power loss in the output transistor Tr1.

Here, the power loss Po in the output transistor Tr1 is represented by:

$$Po=Vi\text{-}o\times Io \quad (1)$$

Accordingly, in order to protect the output transistor Tr1 while maintaining the power loss Po within a predetermined level, it is necessary to suppress the output current Io in response to an increase in the input-output voltage Vi-o as well as to a rise in the input voltage Vi.

FIG. 9 is a block diagram showing an electrical construction of another prior-art dc-stabilized power circuit 11. This dc-stabilized power circuit 11 has an output transistor Tr11 of the PNP-type that is connected between input and output lines 12 and 13. Tap resistors S11 and S12 are connected between the output terminal T12 and a ground terminal T13, and the connecting point 14 is connected to the inversion input terminal of a differential amplifier 15. The reference voltage Vref is applied to the non-inversion input terminal of the differential amplifier 15. Therefore, the lower the electric potential of the connecting point 14 compared with the reference voltage Vref, the greater driving current is outputted from the differential amplifier 15.

The driving current from the differential amplifier 15 is fed to the base of the driving transistor Tr12. The collector of the driving transistor Tr12 is connected to the input line 12, and the emitter is connected to the base of the driving transistor Tr13. The collector of the driving transistor Tr13 is connected to the base of the output transistor Tr11, and the emitter is connected to ground through the resistor S13. Therefore, the driving current is amplified by the driving transistors Tr12 and Tr13 that are connected in Darlington configuration so that the output transistor Tr11 is driven.

Moreover, the electric potential of the connecting point 14 and the terminal voltage of the resistor S13 are applied to a short-circuit/over-current protection circuit 16. The short-circuit/over-current protection circuit 16 suppresses the driving current to be supplied from the differential amplifier 15 to the driving transistor Tr12 by by-passing it from a line 17 to a line 18 in a short-circuit state where the electric potential of the connecting point 14 has dropped or in an over-current state where the terminal voltage of the resistor S13 has risen, thereby carrying out a protecting operation for the output transistor Tr1.

In such a dc-stabilized power circuit 11, it is possible to supply power with a minimum of loss without installing the current-detecting resistor S1 in the output line 13. In other words, the dc-stabilized power circuit 11 cannot detect the output current Io of the output line 13 directly, and therefore is designed to detect a voltage drop at the connecting point 14 and to allow the differential amplifier 15 to generate the driving current in accordance with the detected value. However, although the relationship between the output current Io and the output voltage Vo, which is shown in FIG. 10, has the "knife-edge shaped" characteristics, it hardly varies when variations such as indicated by reference symbols $\alpha 11$ through $\alpha 12$, like those in the dc-stabilized power circuit 1 shown in FIG. 8, are desired in response to an increase in the input-output voltage Vi-o. Therefore, in accordance with the above-mentioned equation 1, this construction causes an increase in the power loss Po in the output transistor Tr11 in response to an increase in the input-output voltage Vi-o as well as to an increase in the input voltage vi, and consequently tends to damage. Thus, it is necessary to provide extra room for the rated current of the output transistor Tr11.

In order to solve such a problem, it has been proposed to provide a method wherein: the output transistor Tr11 is designed to have a so-called multi-collector construction, a detection-use electrode of, for example, 1/100 degree is attached to the main electrode of the collector, and the collector current is found by the current flowing through the detection-use electrode.

However, such a construction is available only when the output transistor Tr11 is assembled as an integrated circuit, and in the case when a greater output current Io, which is to be supplied from the dc-stabilized power circuit 11, is required, the dc-stabilized power circuit 11 should be provided as a two-chip construction including an element of the output transistor Tr11 and a control-use integrated circuit made up of the remaining portions. This makes it impossible to adopt the multi-collector construction in the output transistor Tr11, still failing to prevent damage to the output transistor Tr11.

SUMMARY OF THE INVENTION

The objective of the present invention is to provide a dc-stabilized power circuit capable of protecting its output transistor from damage due to power loss occurring in the output transistor.

In order to achieve the above-mentioned objective, the dc-stabilized power circuit of the present invention is provided with: a PNP-type transistor that functions as a through element and that is connected between input and output terminals; a driving-current supplying means for controlling a driving current of a base of the transistor in accordance with the difference between a voltage obtained by voltage-dividing the voltage of the output terminal and a predetermined reference voltage; and a driving-current suppressing means for detecting a voltage between the input and output terminals and for suppressing a driving current released by the driving-current supplying means based upon the result of the detection.

In the above-mentioned arrangement which is adopted in a dc-stabilized power circuit wherein: a PNP-type transistor is connected between the input and output terminals; the voltage of the output terminal is voltage-divided, and compared with a predetermined reference voltage; and the driving-voltage supplying means controls the driving current of the base of the transistor based on the difference between the two voltages so that the output voltage is controlled, that is, in a dc-stabilized power circuit of a low-loss type wherein the output voltage is controlled without connecting a current-detecting resistor in the output line, the driving-current suppressing means is installed and the voltage between the input and output terminals is detected, and the driving current is further suppressed based on the result of the detection as the voltage between the terminals becomes greater.

Therefore, even in the case of a dc-stabilized power circuit of the two-chip construction wherein the transistor and the control circuit are formed in a discrete manner and wherein the output current of the transistor can not be directly detected, it becomes possible to suppress the output current and to consequently prevent damage to the transistor due to an increase in the loss. For example, in response to an increase in the input voltage, the output current can be suppressed so as to limit the loss due to the transistor. Moreover, this arrangement eliminates the necessity of having to increase the rated current of the transistor to a great extent, thereby reducing the chip size.

Preferably, an operation-controlling means, which activates the driving-current suppressing means when the driving current increases or when it exceeds a predetermined value, may be installed. With this arrangement, the operation-controlling means activates the driving-current suppressing means when it detects that the driving current has increased from a value corresponding to no-load, or when it detects that the driving current has exceeded a predetermined threshold value. Therefore, it is possible to prevent an unwanted increase in the output voltage that occurs during a low-load operation especially under high temperatures, at which a drop in the threshold voltage between the base and emitter of the transistor tends to occur, due to a differential amplifier and other components within the driving-current suppressing means for detecting the voltage between the input and output terminals.

More preferably, an operation-controlling means, which activates the driving-current suppressing means upon detection of a rise in the voltage between the base and transmitter of the transistor, may be installed. With this arrangement, the operation-controlling means activates the driving-current suppressing means when, for example, it detects that the voltage between the base and emitter has risen from a voltage corresponding to no-load or a nearly no-load state to a voltage corresponding to the rated load. Therefore, in such a case when the transistor and the control circuit are sealed as an integral part, that is, in cases when temperature environments are virtually the same between the transistor and the control circuit, the operation-controlling means, which can be achieved by a simple construction including a transistor and a resistor for determining its threshold value for conduction, is adopted in order to control the operation of the driving-current suppressing means. In other words, it is possible to prevent the above-mentioned unwanted increase in the output voltage that occurs during a low-load operation under high temperatures, by simplifying the construction for operation control.

For a fuller understanding of the nature and advantages of the invention, reference should be made to the ensuing detailed description taken in conjunction with the accompanying drawings.

DESCRIPTION OF THE EMBODIMENT

Figure 1:
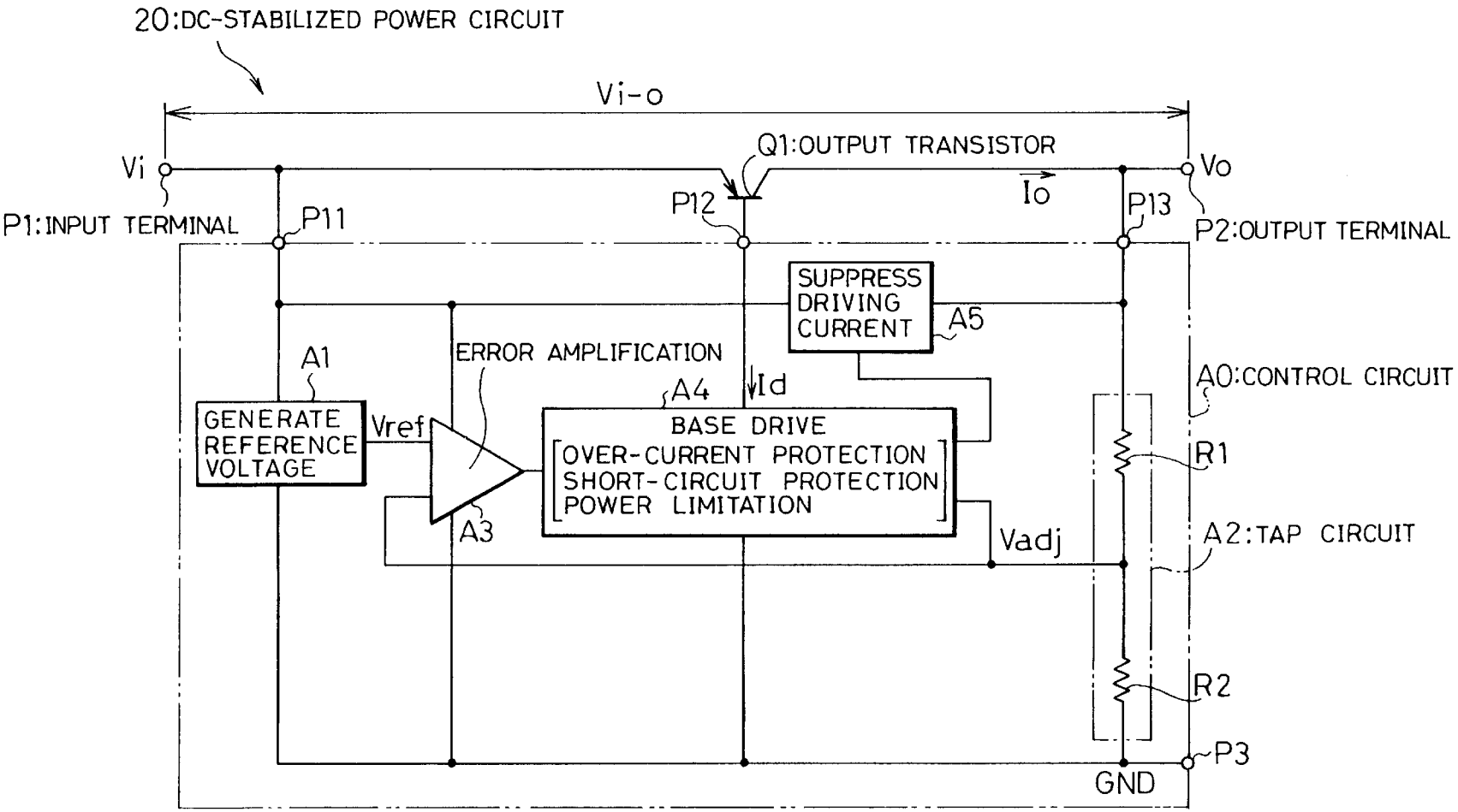
FIG. 1 is a block diagram showing an electrical construction of a basic dc-stabilized power circuit in accordance with one embodiment of the present invention.
Figure 2:
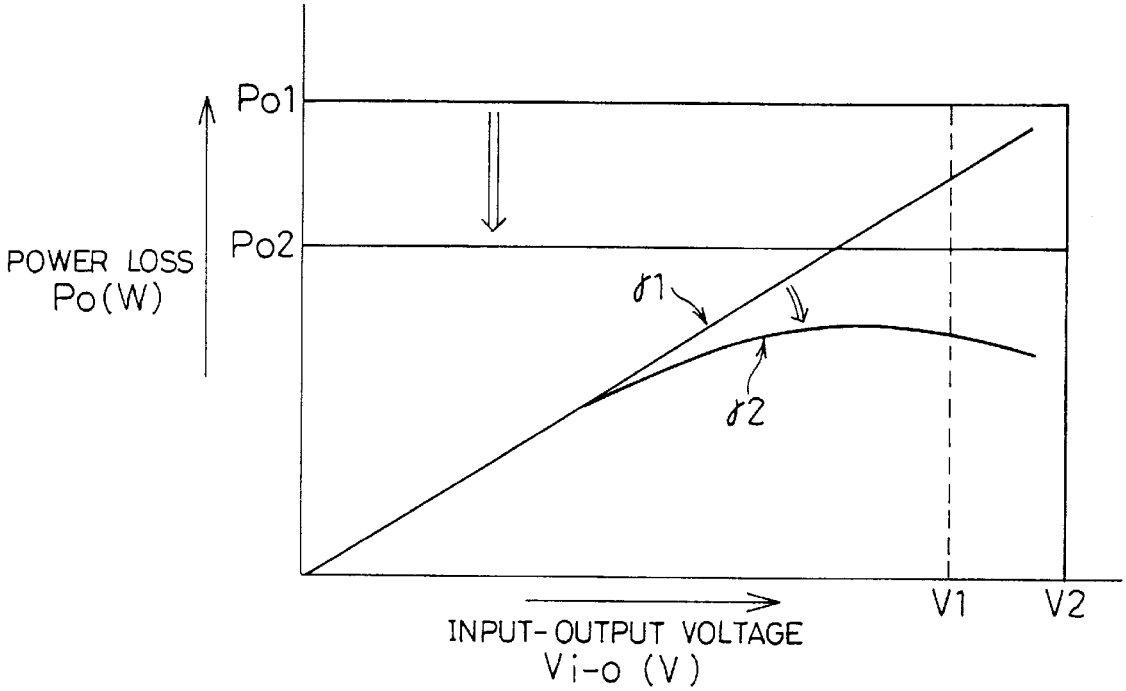
FIG. 2 is a graph that shows the change in power loss Po in response to the change in input-output voltage Vi-o in the case when the dc-stabilized power circuit of the present invention is used.
Figure 3:
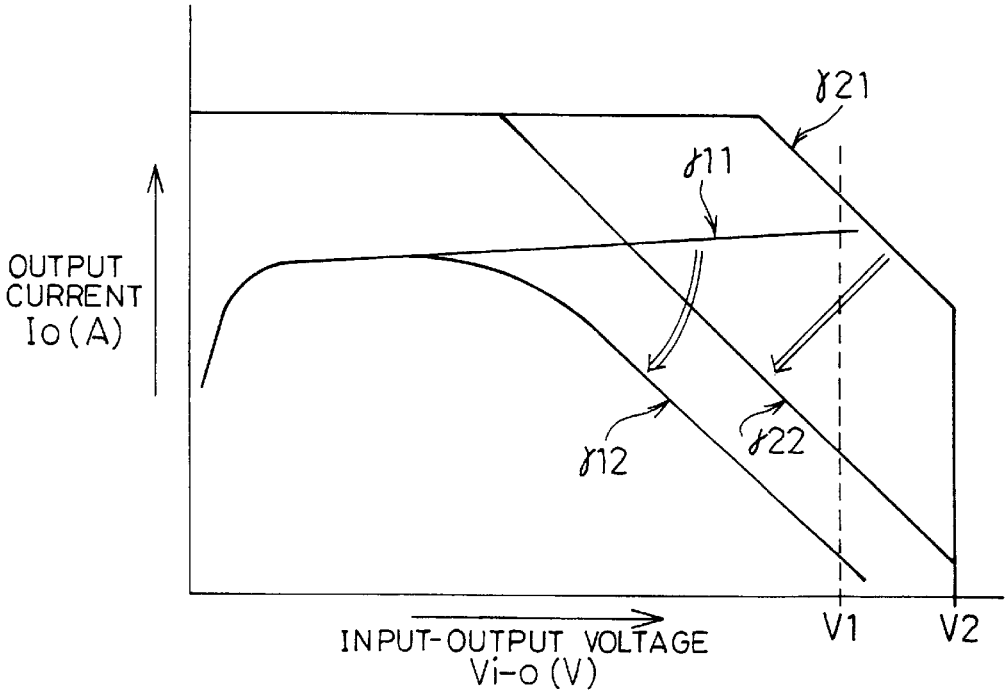
FIG. 3 is a graph that shows the change in output current Io in response to the change in input-output voltage Vi-o in the case when the dc-stabilized power circuit of the present invention is used.

Referring to FIGS. 1 through 3, the following description will discuss one embodiment of the present invention.

FIG. 1 is a block diagram showing an electrical construction of a dc-stabilized power circuit 20 that is one embodiment of the present invention. This dc-stabilized power circuit 20 is a dc-stabilized power circuit of a low-loss type wherein an output transistor Q1 of the PNP-type is connected between an input terminal P1 and an output terminal P2 as a through element, and has a two-chip construction including the output transistor Q1 and a control circuit A0 that is achieved by an integrated circuit having the rest of the circuit elements in an integral manner. The control circuit A0 is constituted of a reference-voltage generation circuit A1, a voltage-dividing circuit A2, an error-amplification circuit A3, a base-driving circuit A4 (driving-current supplying means) and a driving-current suppressing circuit A5 (driving-current suppressing means). The control circuit A0 also has terminals P11, P12 and P13 that are respectively connected to the emitter, base and collector of the output transistor Q1, as well as a ground terminal P3.

The reference-voltage generation circuit A1 is installed between the terminal P11 and the ground terminal P3, and the reference-voltage generation circuit A1 provides a reference voltage Vref that is preliminarily determined from an input voltage Vi. Further, the voltage-dividing circuit A2, which is constituted of tap resistors R1 and R2, is installed between the terminal P13 and the ground terminal P3, and the voltage-dividing circuit A2 releases a voltage Vadj (adjusting voltage) that has been obtained by voltage-dividing an output voltage Vo from the output terminal P2. The difference between the voltage Vadj thus obtained and the reference voltage Vref is amplified by the error-amplification circuit A3. This error-amplification circuit A3 is achieved by a component such as a differential amplifier, and the voltage between the terminal P11 and the ground terminal P3, that is, the above-mentioned input voltage Vi, is applied to the error-amplification circuit A3 as a power-source voltage. The output from the error-amplification circuit A3 is fed to the base-driving circuit A4, and in response to the output from the error-amplification circuit A3, the lower the voltage Vadj becomes compared with the reference voltage Vref, that is, the lower the output voltage Vo becomes, the more the base-driving circuit A4 draws the base-driving current Id of the output transistor Q1 through the terminal P12, thereby increasing the output current Io so as to achieve a constant-voltage operation.

Moreover, as the driving current Id increases, the base-driving circuit A4 suppresses it at a predetermined level, thereby carrying out an over-current protecting operation. As the voltage Vadj decreases, the base-driving circuit A4 also suppresses the driving current Id, thereby carrying out a short-circuit protecting operation.

Furthermore, in the present embodiment, the driving-current suppressing circuit A5 is installed between the terminals P11 and P13, and the driving-current suppressing circuit A5 suppresses the base-driving circuit A4 from drawing the driving current Id, when the input-output voltage Vi-o exceeds a predetermined value.

FIGS. 2 and 3 respectively indicate the changes in the power loss Po and the output current Io in response to the change in the input-output voltage Vi-o. In an arrangement wherein no driving-current suppressing circuit A5 is provided, the power loss Po increases as is indicated by reference mark γ1 in response to an increase in the input-output voltage Vi-o. For this reason, when the rated value of the input-output voltage Vi-o is denoted by V1 and the design margin is denoted by V2, the safety operation area of the output transistor Q1 indicated by Po1. In contrast, with the arrangement having the driving-current suppressing circuit A5 as shown by the present embodiment, the power loss Po is suppressed as is indicated by reference mark γ2 in response to an increase in the input-output voltage Vi-o so that the safety operation area is narrowed to Po2.

Similarly, the output current Io is also suppressed from a state indicated by reference mark γ11 to a state indicated by reference mark γ12, thereby making it possible to narrow the safety operation area of the output transistor Q1 from a state indicated by reference mark γ21 to a state indicated by reference mark γ22.

As described above, in the dc-stabilized power circuit 20 which is constituted of the two chips of the output transistor Q1 and the control circuit A0 and which can achieve a low loss without interpolating a current-detecting resistor into the output line, the power loss of the output transistor Q1 can be suppressed when the input-output voltage Vi-o is great, and its protection can also be provided even in the event of an output short-circuit. Moreover, this arrangement eliminates the necessity of having to increase the rated current of the output transistor Q1 to a great extent, thereby reducing the chip size.

Figure 4:
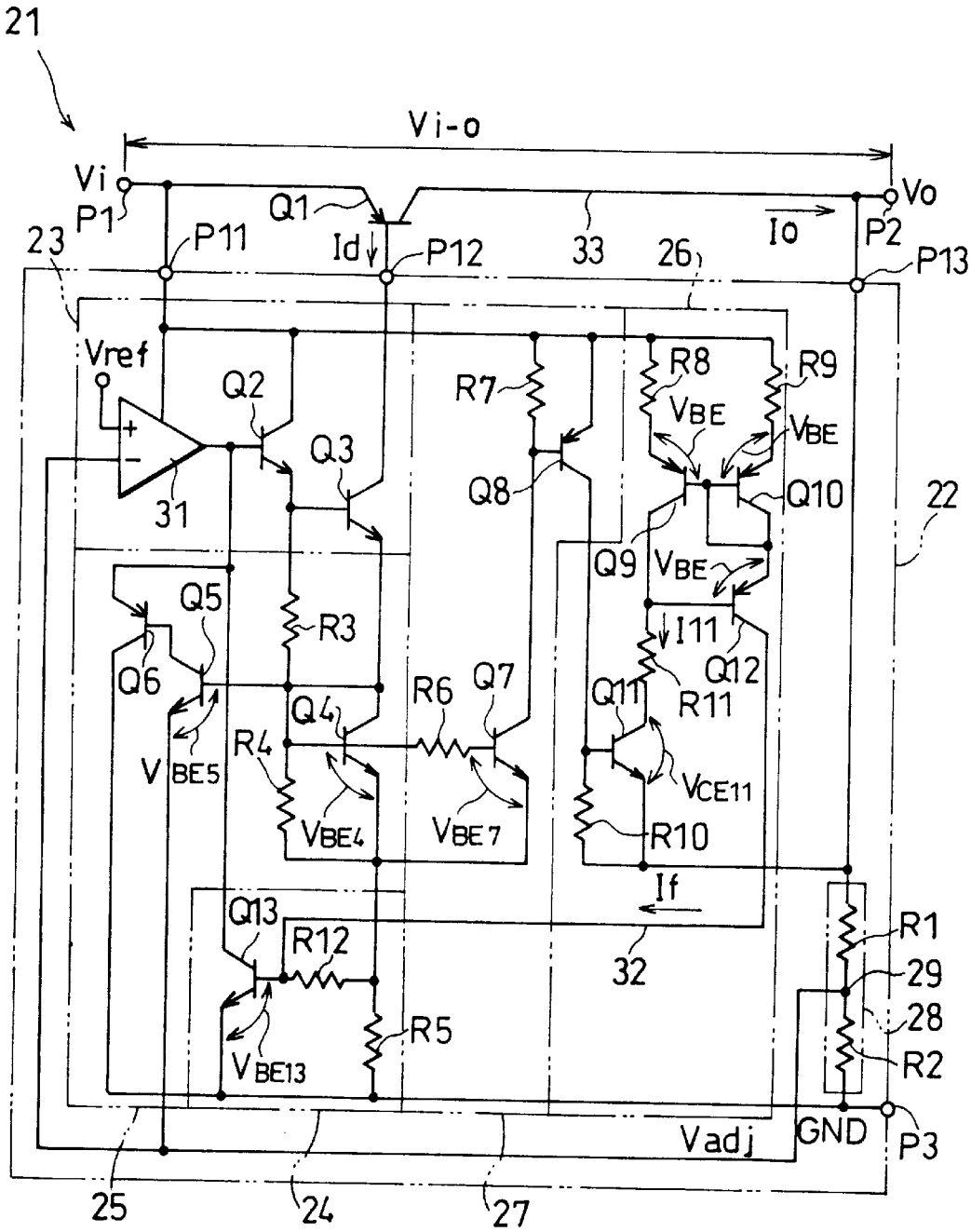
FIG. 4 is an electric-circuit diagram that specifically shows a dc-stabilized power circuit of another embodiment of the present invention.
Figure 5:
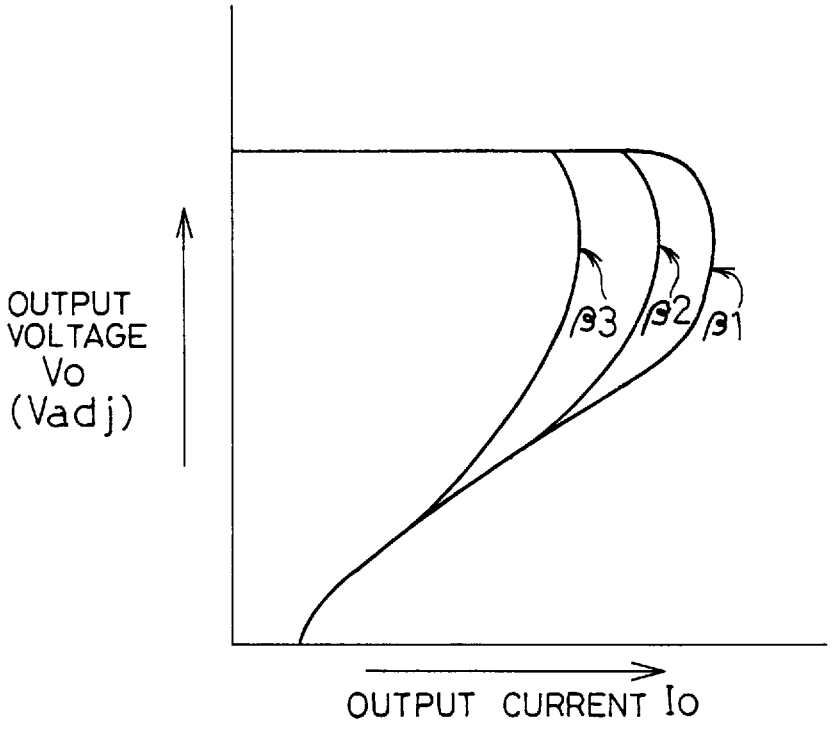
FIG. 5 shows a graph that explains a constant-voltage controlling operation by the dc-stabilized power circuit of the present invention.

Referring to FIGS. 4 and 5, the following description will discuss another embodiment of the present invention.

FIG. 4 is an electrical circuit diagram of a dc-stabilized power circuit 21 in accordance with another embodiment of the present invention. This dc-stabilized power circuit 21 shows a specific construction of the aforementioned dc-stabilized power circuit 20, and the corresponding components are indicated by the same reference numbers. In the dc-stabilized power circuit 21, a control circuit 22 is constituted of a constant-voltage circuit 23 (driving-current supplying means), an over-current protection circuit 24, a short-circuit protection circuit 25, a driving-current suppressing circuit 26 (driving-current suppressing means), an operation-controlling circuit 27 (operation-controlling means), and a voltage-dividing circuit 28.

The voltage-dividing circuit 28, which is constituted of tap resistors R1 and R2, is installed between an output terminal P2 and a ground terminal P3. A voltage Vadj, which is obtained by voltage-dividing an output voltage Vo, is released from an output-adjusting terminal 29 that forms a connecting point of the tap resistors R1 and R2, and supplied to the inversion input terminal of a differential amplifier 31 inside the constant-voltage circuit 23. A predetermined reference voltage Vref, which is generated by a reference-voltage generation circuit, not shown, is inputted to the non-inversion input terminal of the differential amplifier 31.

The constant-voltage circuit 23 is constituted of the differential amplifier 31 and driving transistors Q2 and Q3 that are connected in Darlington configuration. The collector of the driving transistor Q2 is connected to an input terminal P1 through a terminal P11 so that an input voltage Vi is applied thereto. The emitter is connected to the ground terminal P3 through resistors R3 and R4 inside the short-circuit protection circuit 25, as well as a resistor R5 inside the over-current protection circuit 24, and is also connected to the base of the driving transistor Q3. The collector of the driving transistor Q3 is connected to the base of the output transistor Q1 through the terminal P12, and the emitter is connected to the ground terminal P3 through the resistors R4 and R5.

Therefore, the lower the voltage Vadj becomes compared with the reference voltage Vref, the greater driving current the differential amplifier 31 inputs to the base of the driving transistor Q2. This results in an increase in the driving current Id of the output transistor Q1 so that it becomes possible to achieve a constant-voltage operation for maintaining the output voltage Vo constant.

The short-circuit protection circuit 25 is constituted of the resistor R3 through which the emitter current of the driving transistor Q2 flows, the resistor R4 through which a current coming from the resistor R3 and the driving current Id coming from the driving transistor Q3 flow, a transistor Q4 which is ON/OFF driven by a voltage across terminals of the resistor R4, and a pair of by-pass transistors Q5 and Q6 for by-passing the driving current directed to the driving transistor Q2.

The short-circuit protection circuit 25 is operated under the following condition:

$$Vadj+V_{BE5}\approx V_{BE4}+R5\times Id \quad (2)$$

where the base-emitter voltage required for energizing the by-pass transistor Q5 is represented by $V_{BE5}$ and the base-emitter voltage required for energizing the by-pass transistor Q4 is represented by $V_{BE4}$.

Thus, in order to obtain a driving current Id that corresponds to the output voltage Vo, the driving current that is directed from the differential amplifier 31 to the driving transistor Q2 is by-passed by the by-pass transistors Q5 and Q6, and suppressed. Consequently, the "knife-edge shaped" characteristics, as shown in FIG. 5, are achieved, and it becomes possible to protect the output transistor Q1 from damage due to a drop in the output voltage Vo. Here, when the output terminal P2 is completely connected to ground, Vadj=0 V holds, thereby providing the following equation:

$$V_{BE5}=(R4+R5)\times Ids \quad (3)$$

Thus, the base current of the output transistor Q1, represented by Ids, is suppressed, and a short-circuit protecting operation is achieved.

The operation-controlling circuit 27 is constituted of two transistors Q7 and Q8, and their bias-use resistors R6 and R7. The transistor Q7 is connected in parallel with the transistor Q4, and a voltage across terminals that has been generated by the resistor R4 is lowered by the resistor R6, and inputted to the base thereof. Further, the collector of the transistor Q7 is connected to the input terminal P1 through the resistor R7. Thus, when the transistor Q7 is energized, a voltage across terminals of the resistor R7, which is generated by the collector current, energizes the switching transistor Q8. Therefore, when the driving current Id becomes greater than the threshold current that is determined by the resistors R4 and R6 and the base-emitter voltage $V_{BE7}$ of the transistor Q7, the input voltage Vi, which is directed to the input terminal P1, is applied to the driving-current suppressing circuit 26 through the switching transistor Q8 so that the driving-current suppressing circuit 26 is activated.

The driving-current suppressing circuit 26 is constituted of a pair of transistors Q9 and Q10 that form a current-mirror circuit, resistors R8 and R9, a transistor Q11 that is driven by the output from the operation-controlling circuit 27 and its bias-use resistor R10, and a transistor Q12. The emitters of the paired transistors Q9 and Q10 are connected to the input terminal P1 through the resistors R8 and R9 respectively. The collector of the transistor Q9 is connected to the output terminal P2 through the resistor R11, the transistor Q11 and the terminal P13. The transistor Q12 is used for enabling the output of the current-mirror circuit, and the emitter is connected to the bases of the transistors Q9 and Q10 as well as to the collector of the transistor Q10, while the base is connected to the connecting point between the resistor R11 and the collector of the transistor Q9. A current If that corresponds to the input-output voltage Vi-o is released from the collector to a line 32, as will be described later. When the transistor Q8 of the operation-controlling circuit 27 is energized, a bias voltage is applied to the base of the transistor Q11 by the resistor R10 so that the transistor Q11 is energized and the current If is released to the line 32.

Here, the over-current protection circuit 24 is constituted of a by-pass transistor Q13 that is capable of by-passing the driving current that is directed from the differential amplifier 31 to the driving transistor Q2 in the same manner as the transistors Q5 and Q6, its bias-use resistor R5, and a resistor R12. The current If, which flows through the line 32, is supplied to the base of the by-pass transistor Q13. Further, a voltage across terminals of the resistor R5 is inputted to the base of the by-pass transistor Q13 through the input resistor R12. Therefore, the over-current protection circuit 24 is operated in accordance with the following expression:

$$V_{BE13}\approx R12\times If+R5\times(If+Id) \quad (4)$$

where the base-emitter voltage required for energizing the by-pass transistor Q13 is represented by $V_{BE13}$.

Therefore, as the input-output voltage Vi-o becomes greater due to an over-current so that the current If becomes greater, R12×If and R5×If become greater, thereby allowing R5×Id to become smaller, that is, allowing the driving current Id to be suppressed. Thus, it is possible to carry out a protecting operation against over-currents.

With respect to the control circuit 22 having the above-mentioned arrangement, the following description will specifically discuss a suppressing operation on the power loss Po in the output transistor Q1, which is carried out by the driving-current suppressing circuit 26 of the present invention. Supposing that the current amplification factor of the output transistor Q1 is hFE, the output current Io released by the output transistor Q1 is represented as follows:

$$Io=hFE\times Id \quad (5)$$

Thus, according to the aforementioned equation (1), the power loss Po is represented as follows:

$$Po=Vi\text{-}o\times hFE\times Id \quad (6)$$

Accordingly, it is found that the power loss Po can be controlled so as to be reduced to not more than a predetermined level by controlling the driving current Id of the output transistor Q1 based upon the input-output voltage Vi-o and the dependence of the current amplification factor hFE on the input-output voltage Vi-o.

Here, in the operating state of the driving-current suppressing circuit 26, the following expression is satisfied:

$$Vi\text{-}o=2\times V_{BE}+R11\times I11+V8+V_{CE11}\ (sat) \quad (7)$$

where $V_{BE}$ represents the base-emitter voltage required for energizing the transistors Q9, Q10 and Q12, I11 represents a value of a current that flows through the resistor R11, V8 represents a voltage drop caused by the resistor R8, and $V_{CE11}$ (sat) represents the collector-emitter saturated voltage of the transistor Q11.

Moreover, in accordance with the current-mirror operation of the transistors Q9 and Q10, I11≈If is satisfied. Therefore, in the above-mentioned expression (7), supposing that, for example, Vi-o=3 V, $V_{BE}$=0.7 V, R11=10 kΩ, V8=0.2 V, and $V_{CE11}$ (sat)=0.1 V, If=130 $\mu$A holds. Here, supposing that Vi-o=20 V, If=1.83 mA holds.

Therefore, as indicated by the aforementioned expression (4), the driving current Id decreases in inverse proportion to such an increase in the current If; this makes it possible to achieve a suppressing operation on the driving current Id wherein the power loss Po is reduced to not more than a predetermined level. Consequently, it becomes possible to suppress the output current Io in response to an increase in the input-output voltage Vi-o, as is sequentially indicated by reference marks β1, β2 and β3 in FIG. 5.

As described above, in the dc-stabilized power circuit 21 which is constituted of the two chips of the output transistor Q1 and the control circuit 22 and which can achieve a low loss without interpolating a current-detecting resistor into the output line 33, the output current Io is suppressed in response to an increase in the power loss Po due to the output transistor Q1; therefore, it is possible to prevent damage to the output transistor Q1 beforehand. Further, this arrangement also eliminates the necessity of having to increase the rated current of the output transistor Q1 to a great extent, thereby reducing the chip size.

Moreover, in the case when the driving-current suppressing circuit 26 is always active, if the input voltage Vi is high in nearly no-load state, a current flows toward the output terminal P2 through the transistors Q9 and Q11. Here, the threshold voltage between the base and emitter of a transistor drops, for example, by 2 mV per temperature rise of 1° C. For this reason, the output voltage Vo rises undesirably following the drop of the base-emitter voltage $V_{BE}$ especially at high temperatures. However, when the driving current Id is reduced, the operation-controlling circuit 27 renders the driving-current suppressing circuit 26 inactive, thereby eliminating the above-mentioned problem.

Figure 6:
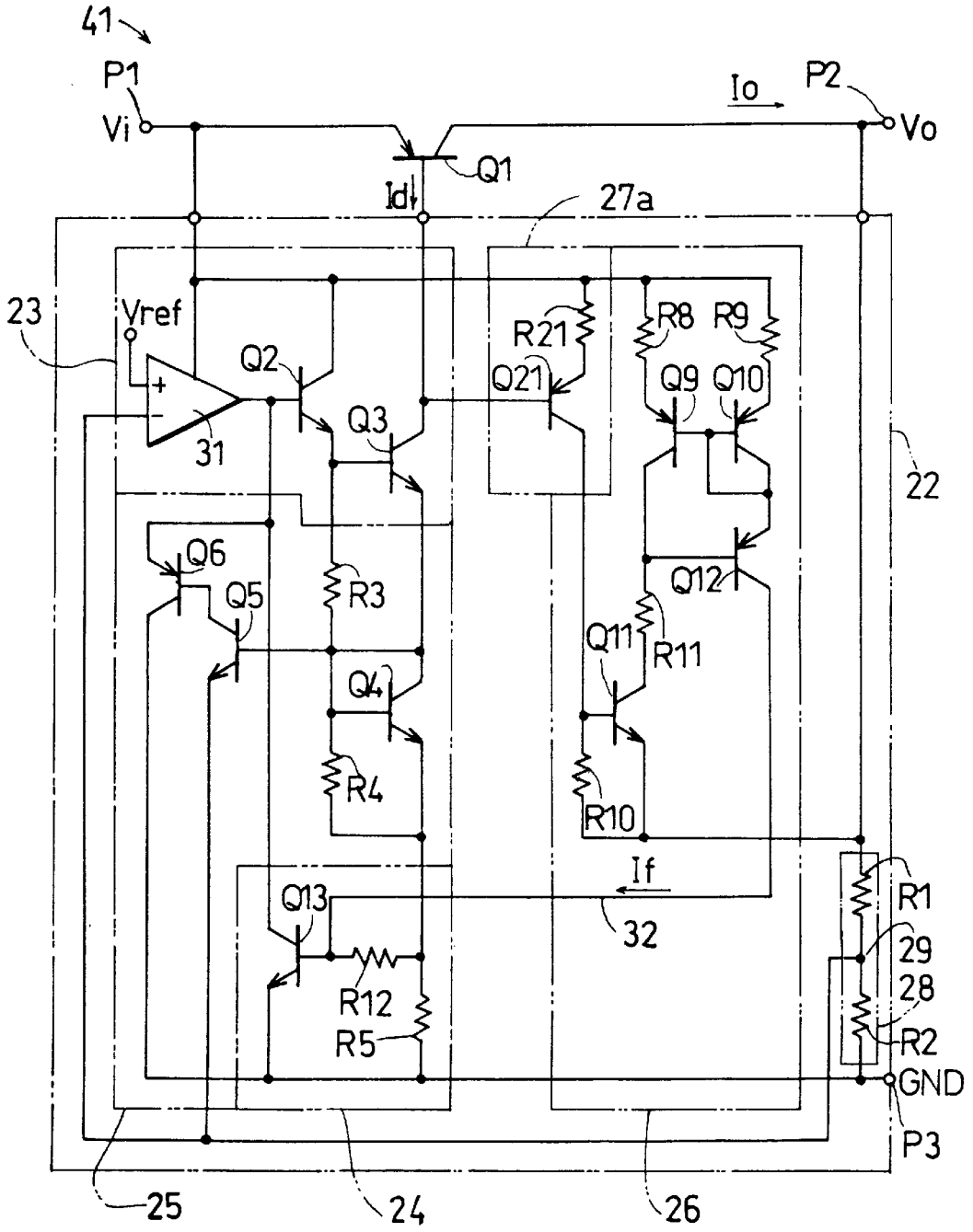
FIG. 6 is an electric-circuit diagram that specifically shows a dc-stabilized power circuit of still another embodiment of the present invention.
Figure 7:
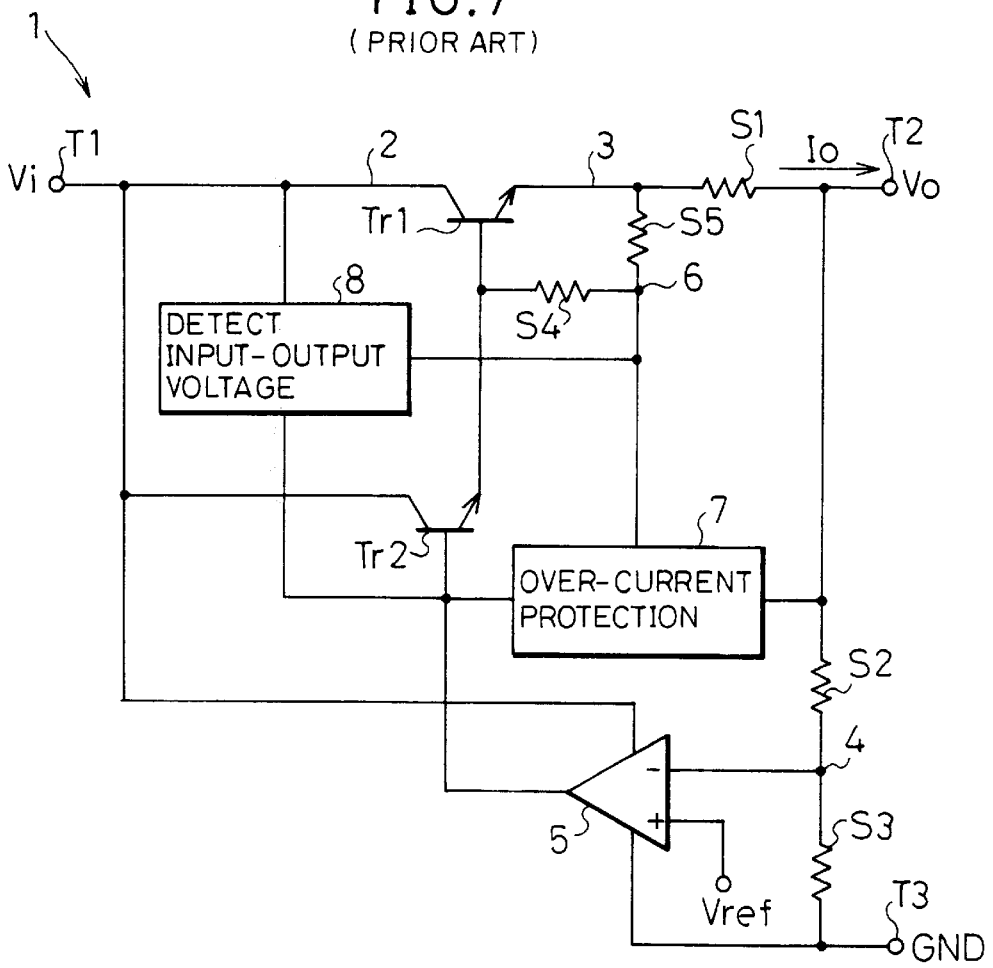
FIG.7 (PRIOR ART)
FIG. 7 is a block diagram showing an electrical construction of a typical, prior-art dc-stabilized power circuit.
Figure 8:
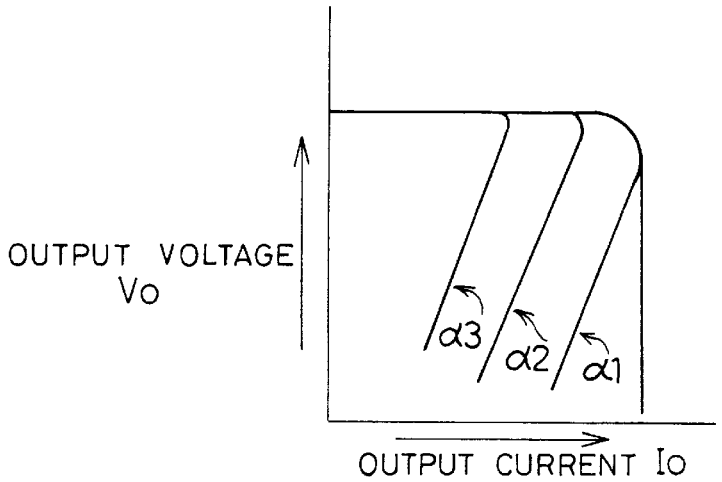
FIG.8 (PRIOR ART)
FIG. 8 shows a graph that explains the constant-voltage controlling operation of the dc-stabilized power circuit of FIG. 7.
Figure 9:
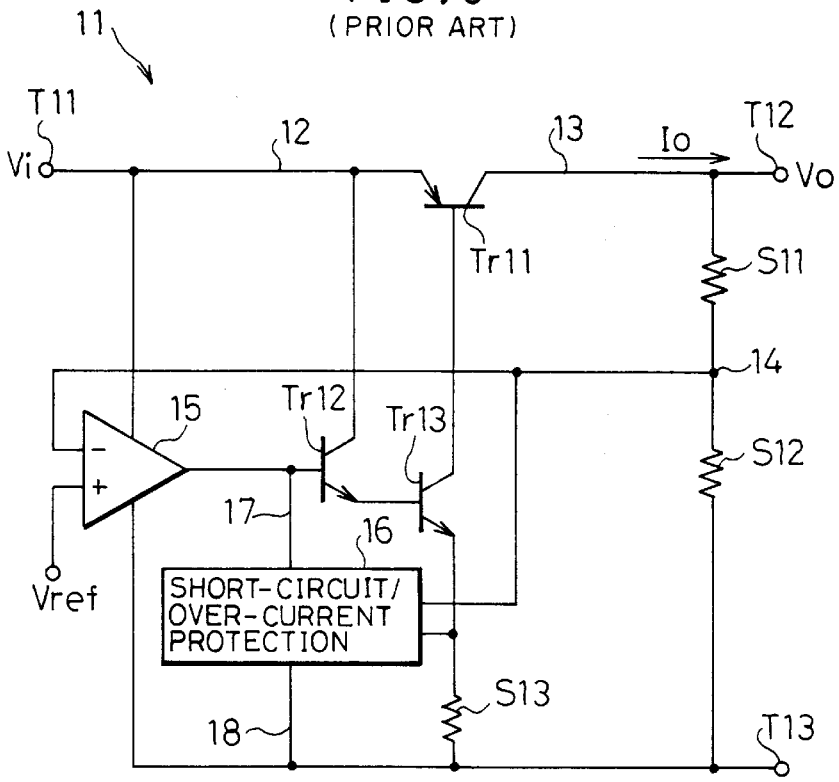
FIG. 9 (PRIOR ART)
FIG. 9 is a block diagram showing an electrical construction of another prior-art dc-stabilized power circuit.
Figure 10:
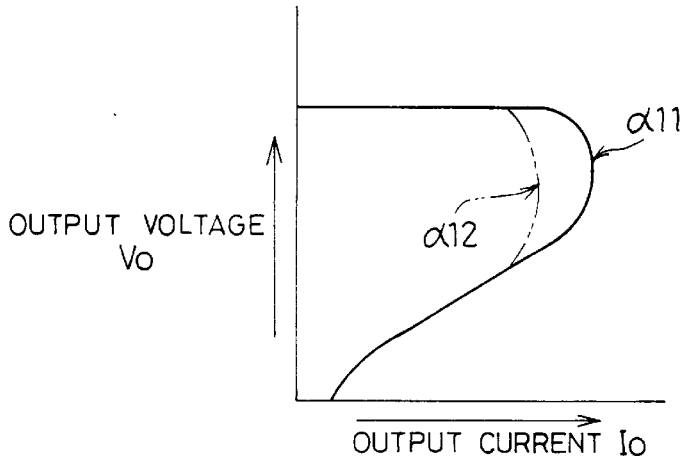
FIG. 10 (PRIOR ART)
FIG. 10 shows a graph that explains the constant-voltage controlling operation of the dc-stabilized power circuit of FIG. 9.

Referring to FIG. 6, the following description will discuss still another embodiment of the present invention.

FIG. 6 is an electrical circuit diagram of a dc-stabilized power circuit 41 in accordance with still another embodiment of the present invention. This dc-stabilized power circuit 41 is similar to the aforementioned dc-stabilized power circuit 21, and the corresponding components are indicated by the same reference numbers and the description thereof is omitted. In the dc-stabilized power circuit 41, an operation-controlling circuit 27*a* is constituted of a switch transistor Q21 and a resistor R21. The base of the switch transistor Q21 is connected to the collector of the driving transistor Q3, that is, to the base of the output transistor Q1, the collector is connected to the resistor R10 and the base of the transistor Q11, and the emitter is connected to the input terminal P1 through the resistor R21.

In contrast with the aforementioned dc-stabilized power circuit 21 wherein the driving-current suppressing circuit 26 is activated when the driving current Id becomes not less than a predetermined level, the driving-current suppressing circuit 26 may be activated by detecting a rise in the base-emitter voltage of the output transistor Q1, as is provided by the dc-stabilized power circuit 41. This arrangement is preferably adopted when the same temperature environment can be provided for the switch transistor Q21 and the output transistor Q1 by such a method as sealing the output transistor Q1 integrally with the control circuit 22, thereby making it possible to simplify the construction used for operation control.

Even when compared with an arrangement wherein the output transistor has a multi-collector construction, which is adopted when the output transistor and the control circuit are formed as an integral part, the above-mentioned arrangement achieves lower costs because no special construction is required for the output transistor Q1.

Furthermore, in the above-mentioned operation control, the detection of an increase in the driving current Id may be carried out by a method that, for example, detects a state in which the driving current Id becomes greater than a value under no-load, or a state in which it becomes greater and exceeds a predetermined rate of change.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A dc-stabilized power circuit, which has no current-detecting resistor connected between input and output terminals, comprising:

a PNP-type transistor that functions as a through element and that is connected between input and output terminals;

a voltage-dividing circuit configured to voltage divide an output voltage from the output terminal so as to output an adjusting voltage;

driving-current supplying means for controlling a driving current of a base of the transistor in accordance with the difference between the adjusting voltage and a predetermined reference voltage; and driving-current suppressing means for detecting a voltage between the input and output terminals and for suppressing a driving current released by the driving-current supplying means based upon the result of the detection.

2. The dc-stabilized power circuit as defined in claim 1, further comprising:

operation-controlling means for activating the driving-current suppressing means when the driving current increases, or when the driving current becomes not less than a predetermined value.

3. The dc-stabilized power circuit as defined in claim 1, further comprising:

operation-controlling means for activating the driving-current suppressing means upon detection of a rise in the base-emitter voltage of the transistor.

4. A dc-stabilized power circuit, which has no current-detecting resistor connected between input and output terminals, comprising:

a PNP-type transistor that functions as a through element and that is connected between the input and output terminals;

a reference-voltage generation circuit for generating a reference voltage that is preliminarily determined from a voltage from the input terminal;

a voltage-dividing circuit for voltage-dividing an output voltage from the output terminal so as to output an adjusting voltage;

an error-amplification circuit for amplifying the difference between the adjusting voltage and the reference voltage and outputting the resulting voltage; and a base-driving circuit for further drawing the driving current of the base of the output transistor in response to the output from the error-amplification circuit, as the adjusting voltage becomes lower than the reference voltage; and a driving-current suppressing circuit for detecting a voltage between the input and output terminals and for suppressing the base-driving circuit from drawing the driving current in response to the results of detection.

5. The dc-stabilized power circuit as defined in claim 4, being provided on two chips, one chip having thereon the output transistor, the other chip having thereon a control circuit that integrally includes the reference-voltage generation circuit, the voltage-dividing circuit, the error-amplification circuit, the base-driving circuit and the driving-current suppressing circuit.

6. A dc-stabilized power circuit, which has no current-detecting resistor connected between input and output terminals, comprising:

a PNP-type transistor that functions as a through element and that is connected between the input and output terminals;

a voltage-dividing circuit for voltage-dividing an output voltage from the output terminal so as to output an adjusting voltage;

a constant-voltage circuit for controlling the driving current of the base of the output transistor in response to the difference between the adjusting voltage and a predetermined reference voltage so as to maintain the output voltage constant;

a short-circuit protection circuit for suppressing the driving current as the adjusting voltage drops, in order to protect the output transistor from the drop of the output voltage;

a driving-current suppressing circuit for outputting a current corresponding to the voltage between the input and output terminals so as to suppress the driving current;

an operation-controlling circuit for activating the driving-current suppressing circuit; and an over-current protection circuit for suppressing the driving current in response to the current from the driving-current suppressing circuit, or when the driving current becomes not less than a predetermined value, so as to carry out a protecting operation against over-currents.

7. The dc-stabilized power circuit as defined in claim 6, wherein the operation-controlling circuit activates the driving-current suppressing circuit when the driving current increases, or when the driving current becomes not less than a predetermined value.

8. The dc-stabilized power circuit as defined in claim 6, wherein the operation-controlling circuit activates the driving-current suppressing circuit upon detection of a rise in the base-emitter voltage of the output transistor.

9. The dc-stabilized power circuit as defined in claim 6, being provided on two chips, one chip having thereon the output transistor, the other chip having thereon a control circuit that integrally includes the voltage-dividing circuit, the constant-voltage circuit, the short-circuit protection circuit, the operation-controlling circuit, and the over-current protection circuit.

* * * * *